US005467519A

United States Patent [19]

Tippins et al.

[11] Patent Number: 5,467,519

[45] Date of Patent: * Nov. 21, 1995

[54] INTERMEDIATE THICKNESS TWIN SLAB CASTER AND INLINE HOT STRIP AND PLATE LINE

[75] Inventors: George W. Tippins; John E. Thomas, both of Pittsburgh, Pa.

[73] Assignee: Tippins Incorporated, Pittsburgh, Pa.

[ * ] Notice: The portion of the term of this patent subsequent to Jan. 11, 2011, has been disclaimed.

[21] Appl. No.: 179,109

[22] Filed: Jan. 10, 1994

[51] Int. Cl.[6] ..... B21B 1/00; B21B 13/22

[52] U.S. Cl. ..... 29/527.7; 72/202; 72/229; 29/33 C; 29/DIG. 5

[58] Field of Search ..... 29/527.7, 33 C, 29/DIG. 5; 72/202, 229

[56] References Cited

U.S. PATENT DOCUMENTS

| | | | |
|---|---|---|---|
| 4,229,878 | 10/1980 | Ushijima | 29/527.7 |
| 4,503,697 | 3/1985 | Tippins et al. | 72/202 |
| 4,630,352 | 12/1986 | Ginzburg et al. | 29/527.7 |
| 4,698,897 | 10/1987 | Frommann et al. | 29/527.7 |
| 4,793,169 | 12/1988 | Ginzburg | 72/240 |
| 4,958,677 | 9/1990 | Kimura | 164/452 |
| 5,133,205 | 7/1992 | Rostik et al. | 72/200 |
| 5,150,597 | 9/1992 | Sekiya et al. | 72/229 |
| 5,276,952 | 1/1994 | Thomas et al. | 29/527.7 |

OTHER PUBLICATIONS

Michael G. Sendzimir; Hot strip mills for thin slab continuous casting systems; Iron and Steel Engineer, Oct. 1986; pp. 36–43.

E. Buch and P. Fink; Continuous thin slab casting–direct rolling. Why the planetary hot strip mill?; May. 1987.

*Primary Examiner*—Carl J. Arbes

*Attorney, Agent, or Firm*—Webb, Ziesenheim, Bruening, Logsdon, Orkin & Hanson

[57] ABSTRACT

A method and apparatus of making coiled plate, sheet in coiled form or discrete plate. The apparatus is an intermediate thickness slab caster and inline hot strip and plate line. The apparatus includes a continuous strip caster selectively forming a single or a pair of parallel strands of between 3.5 inches (8.9 cm) and 5.5 inches (14 cm) thick, preferably 5 inches (12.7 cm); a shear for cutting each strand into a slab of desired length; a slab table including a slab takeoff operable transverse of the conveyor table; a slab collection and storage area adjacent to the slab conveyor table adapted to receive slab from the slab takeoff; a reheat furnace having an entry inline with both the slab conveyor table and the slab collection and storage area for receiving slabs from either; a feed and run back table at the exit of the reheat furnace; a pair of tandem hot reversing mills for reducing the slab to a coiling thickness in a minimum number of flat passes; a pair of coiler furnaces located on opposite sides of the tandem hot reversing mills; and a finishing line downstream of the pair of coiler furnaces.

18 Claims, 7 Drawing Sheets

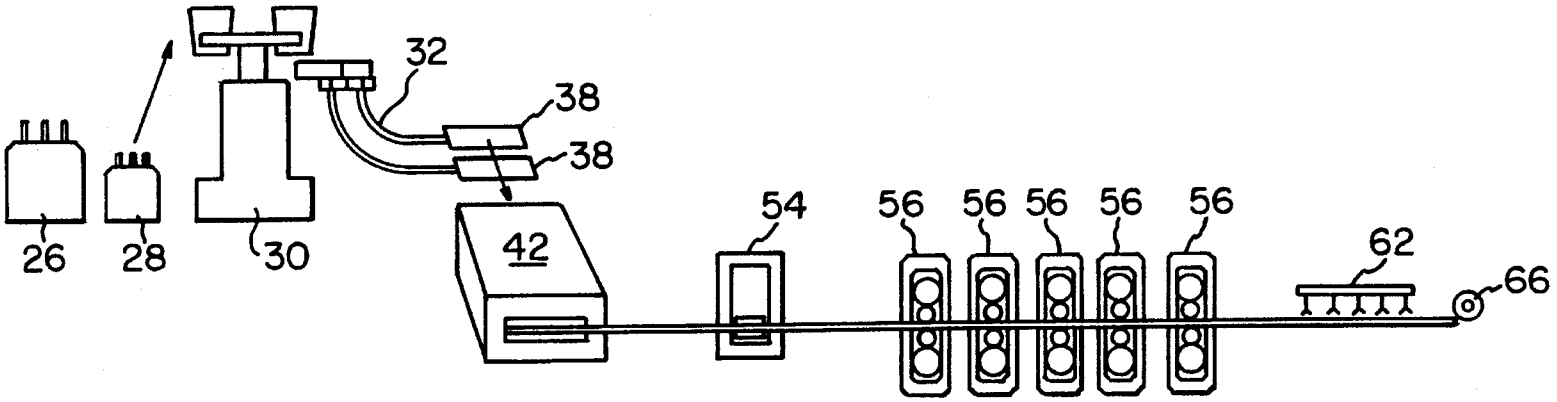
FIG. 3C
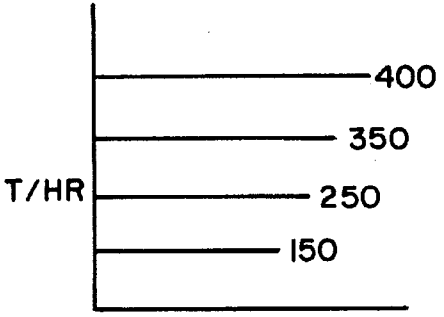
LIQUID STEEL PRODUCTION RATES
FIG. 3D
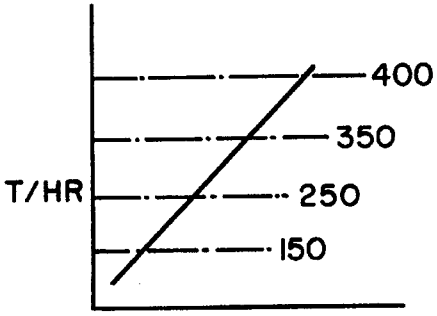
WIDTH CASTER PRODUCTION RATES
FIG. 3E
EQUALIZING FURNACE RATES
FIG. 3F

CONTINUOUS CASTER PROCESS UNIT SINGLE CAST SLAB

CONTINUOUS CASTER PROCESS UNIT TWIN CAST SLAB

INTERMEDIATE THICKNESS TWIN SLAB CASTER AND INLINE HOT STRIP AND PLATE LINE

FIELD OF THE INVENTION

This invention relates to the continuous casting and rolling of slabs and, more particularly, to an integrated intermediate thickness twin caster and a hot reversing mill.

BACKGROUND OF THE INVENTION

Beginning with the advent of the continuous casting of slabs in the steel industry, the industry has been trying to couple the hot strip mill to the continuous caster through an inline arrangement so as to maximize production capability and minimize the equipment and capital investment required. The initial efforts in this regard consisted of integrating continuous casters producing slabs on the order of 6 inches (15.2 cm) to 10 inches (25.4 cm) with existing continuous or semi-continuous hot strip mills. These existing hot strip mills included a reheat furnace, a roughing train, or a reversing rougher, and a six or seven stand finishing mill with a capacity of 1.5 to 5 million tons per year. This mill arrangement is the present day design of large steel company mills and it is unlikely that new hot strip mills of this design would ever be built due to the high capital cost associated therewith. However, the quest for low cost integrated caster hot strip mills is not solved by current designs. Further, such prior art integrated mills were extremely inflexible as to product mix and thus market requirements.

These difficulties gave rise to the development of the so-called thin slab continuous hot strip mill which typically produces i million tons or less of steel per year as specialized products. These mills have been integrated with thin slab casters which produce slabs on the order of 2 inches (5.1 cm) or less. Such integrated thin slab casters are enjoying increased popularity but are not without serious drawbacks of their own. Significant drawbacks include the quality and quantity limitations associated with the so-called thin slab casters. Specifically, the trumpet type mold necessary to provide the metal for the thin slab can cause high frictional forces and stresses along the surface of the thin slab which leads to poor surface quality in the finished product. Further, the 2 inch (5.1 cm) strip casters are limited to a single tundish life of approximately seven heats because of the limited metal capacity of the mold.

Most importantly, the thin casters by necessity have to cast at high speeds to prevent the metal from freezing in the current ladle arrangements. The required volume of steel also necessitates a relatively high casting speed. Both the trumpet casting nozzle and the relatively high casting speed can create problems in the surface quality of the slab. This relatively high casting speed requires the tunnel furnace which is just downstream of the slab caster to be extremely long, often on the order of 500 feet (152.4 m), to accommodate the speed of the slab and still be able to provide the heat input to a thin slab (2 inches (5.1 cm)) which loses heat at a very high rate. The lengthy furnace can result in increased scale pickup and greater risk of surface flaws in the slab. Since the slab also leaves the furnace at a high speed, one needs the multi-stand continuous hot strip mill to accommodate the rapidly moving strip and roll it to sheet and strip thicknesses. However, such a system is still unbalanced, in terms of capacity of the respective elements, at normal widths since the caster has a capacity of about 800,000 tons per year and the continuous mill has a capacity of 2.4 million tons per year. The capital cost per ton per year then approaches that of the earlier prior art systems that it was intended to replace.

In addition, the scale loss as a percentage of slab thickness is substantial for the 2 inch (5.1 cm) thin cast slab. Because of the extremely large furnace, one must provide a long roller hearth which becomes very maintenance intensive because of the exposed rotating rollers.

The typical multi-stand hot strip mill likewise requires a substantive amount of work in a short time which must be provided for by larger horsepower rolling stands which, in some cases, can exceed the energy capabilities of a given area, particularly in the case of emerging countries. Thin slab casters likewise are limited as to product width because of the inability to use vertical edgers on a 2 inch (5.1 cm) slab. In addition, such casters are currently limited to a single width. Further problems associated with the thin strip casters include the problems associated with keeping the various inclusions formed during steelmaking away from the surface of the thin slab where such inclusions can lead to surface defects if exposed. In addition, existing systems are limited in scale removal because thin slabs lose heat rapidly and are thus adversely affected by the high pressure water normally used to break up the scale.

The conventional casters with inline processing and the known thin slab casters with inline processing fail to provide an adequate combination of broad product mix production levels, quality product and capital expense.

In addition, the prior art thin strip processes can only operate in a continuous manner, which means that a breakdown anywhere in the process stops the entire line often causing scrapping of the entire product then being processed.

It is an object of our invention to integrate a twin slab caster with a continuous processing line. It is a further object to provide a system which balances the rate of the caster to the rate of the rolling mill or mills. It is also an object of our invention to provide a system using less thermal and electrical energy. It is further an object of our invention to provide a system capable of producing up to 2 million tons per year. It is still a further object to provide an automated system with small capital investment, broad product mix, adequate production and quality level, reasonable floor space requirements, reasonably powered rolling equipment and low operating costs.

SUMMARY OF THE INVENTION

Our invention provides for a versatile integrated caster and mini-mill capable of producing on the order of 2 million finished tons a year and higher. Such a facility can produce product 24 inches (61 cm) to 120 inches (305 cm) wide and can routinely produce a product of 800 PIW (14.3 kg per mm) with 1,000 PIW (17.9 kg per mm) also being possible. This is accomplished using a twin casting facility having a fixed and adjustable width mold with a straight rectangular cross section without the trumpet type mold. The caster includes an adjustable mold of 125 inches (318 cm) which includes a 5 inch (12.7 cm) refractory block which can be positioned therein to provide for twin casting of parallel strands. The caster has a mold which contains enough liquid volume to provide sufficient time to make flying tundish changes, thereby not limiting the caster run to a single tundish life. Our invention provides a slab approximately two and one half times as thick as the known thin cast slab, which is about 2 inches (5.1 cm) thick, thereby losing much less heat and requiring a lesser input of Btu's of energy. Our invention provides a slab having a lesser scale loss due to reduced surface area per volume and permits the use of a reheat or equalizing furnace with minimal maintenance required. Further, our invention provides a caster which can operate at conventional caster speeds and conventional descaling techniques. Our invention provides for the selection of the optimum thickness cast slab to be used in conjunction with a pair of tandem hot reversing mills providing a balanced production capability. Our invention has the ability to separate the casting from the rolling if there is a delay in either end. In addition, our invention provides for the easy removal of transitional slabs formed when molten metal chemistry changes or width changes are made in the caster.

All of the above advantages are realized while maintaining the advantages of a thin caster which include low ferrostatic head, low weight of slab, straight molds, shorter length molds, smaller required mold radius, low cooling requirements, low burning costs or shear capacity, and simplified machine constructions.

Our invention provides an intermediate thickness slab caster integrated with a hot strip and plate line which includes a reheat or equalizing furnace capable of receiving slabs directly from the caster, from a slab collection and storage area positioned adjacent the slab conveyor table exiting the continuous caster or from another area. A feed and run-out table is positioned at the exit end of the reheat furnace and inline with a pair of tandem hot reversing mills having a coiler furnace positioned on either side of the pair of reversing mills. The mills have the capability of reducing the cast slab to a thickness sufficient for coiling which is about 1 inch (2.54 cm) thick or less in a minimum number of flat passes. The combination coil, coiled plate, sheet in coil form or discrete plate finishing line extends inline and downstream of the hot reversing mills with their integral coiler furnaces. The finishing facilities include a cooling station, a downcoiler, a plate table, a shear, a cooling bed crossover, a plate side and end shear and a piler.

To achieve the necessary balance between the hot reversing mill and the caster, it is necessary to produce slabs having a thickness between 3.5 inches (8.9 cm) to 5.5 inches (14 cm), preferably 5 inches (12.7 cm). The slabs are reduced to about 1 inch (2.54 cm) or less in four flat passes through the hot reversing mills before starting the coiling of the intermediate product between the coiler furnaces as it is further reduced to the desired finished product thickness. With the pair of hot reversing mills, two passes of the slab are taken with each passage of the slab from one coiler furnace to the other coiler furnace. In order to provide the capability of making coiled plate, discrete plate and sheet in coil form up to 1,000 PIW (17.9 kg per mm) and higher, slab width may vary from 24 inches (61 cm) to 120 inches (305 cm).

A preferred method of operation includes feeding a sheared or torch cut slab from the twin caster onto a slab table which either feeds directly into a reheat or equalizing furnace or into a slab collection and storage area adjacent to the slab table. The preferred method further includes feeding the slab directly into the furnace from the slab table. However, the method allows for the feeding of a previously collected and stored slab into the furnace for further processing.

BRIEF DESCRIPTION OF THE DRAWINGS

FIGS. 3A–3G are schematic illustrations of the process flow of various embodiments of the present invention and graphs illustrating the process variability of each process unit;

DESCRIPTION OF THE PREFERRED EMBODIMENT

Figure 1:
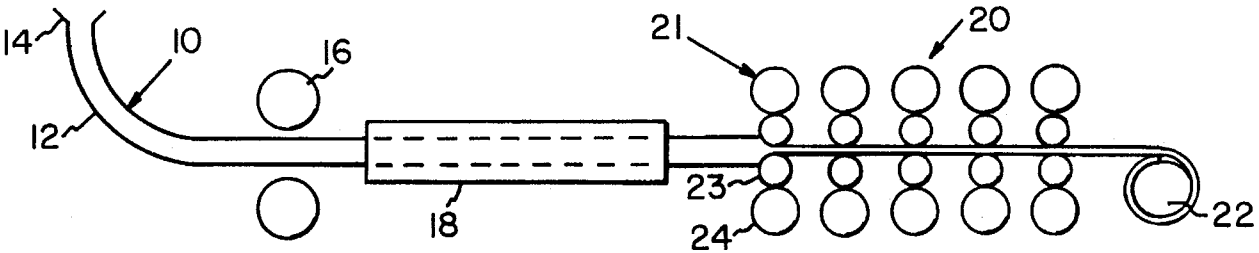
FIG. 1 PRIOR ART
FIG. 1 is a schematic drawing of the prior art thin strip caster and continuous hot mill.

The prior art thin strip caster and inline continuous hot strip mill is illustrated in FIG. 1. The slab caster 10 consists of a curved trumpet mold 12 into which molten metal is fed through entry end 14. An electric furnace, the ladle station and the tundish (not shown) which feeds the continuous caster 10 are also conventional. The slab caster 10 casts a strand on the order of 2 inches (5.1 cm) or less which is cut into slabs of appropriate length by a shear or a torch cut 16 which is spaced an appropriate distance from the curved mold 12 to assure proper solidification before shearing. The thin slab then enters an elongated tunnel furnace 18 where the appropriate amount of thermal input takes place to insure that the slab is at the appropriate temperature throughout its mass for introduction into the continuous hot strip 20 located downstream of the tunnel furnace. The typical existing continuous hot strip 20 includes five or six roll stands 21 each consisting of a pair of work rolls 23 and a pair of backup rolls 24. Additional stands are contemplated for thinner product. Roll stands 21 are spaced and synchronized to continuously work the slab through all five to seven roll stands. The resultant strip of the desired thickness is coiled on a downcoiler 22 and is thereafter further processed into the desired finished steel mill product.

The thin strip caster and continuous hot strip mill enjoy many advantages but have certain fundamental disadvantages, such as no room for error in that the continuous hot strip mill is directly integrated with the caster with no buffer therebetween to accommodate for operating problems in either the caster or the continuous hot strip mill.

In addition, the thermal decay is substantially greater for a 2 inch (5.1 cm) slab as compared to a 5 inch (12.7 cm) slab as in the present invention. This then requires a long tunnel furnace for the 2 inch (5.1 cm) slab to assure the appropriate rolling temperature. This is discussed and illustrated in Applicants' co-pending U.S. patent application Ser. No. 07/881,615 filed May 12, 1992 and co-pending U.S. patent application Ser. No. 08/123,149 filed Sep. 20, 1993, both of which are directed toward an intermediate thickness slab caster and inline hot strip and plate line casting slabs between 3.5 inches (8.9 cm) and 5.5 inches (14 cm), preferably 4 inches (10.2 cm). These applications are herein incorporated by reference. With a 2 inch (5.1 cm) thick cast slab, the mean body temperature of the as-cast slab is only 1,750° F. (954° C.), which is too low a temperature to begin hot rolling. Since there is virtually no reservoir of thermal energy in the center of the slab due to its thin thickness, additional heat energy is required to attain the required mean body temperature of 2,000° F. (1,093+ C.) for hot rolling.

Accordingly, since the thin slab is approximately 150 feet (45.7 m) long, it generally is heated in a long tunnel furnace. Such a furnace must provide the heat energy of approximately 120,000 Btu's per ton to bring the steel up to a mean body temperature of 2,000° F. (1,093° C.) for hot rolling and, in addition, provide additional energy to establish the necessary heat gradient required to drive the heat energy into the slab in the time dictated by the 2 inch (5.1 cm) caster/rolling mill process.

In addition, while the 2 inch (5.1 cm) thick slab is travelling through the tunnel furnace, the atmosphere of the furnace is forming "mill scale" on the exposed surface of the thin slab. This mill scale is detrimental to the quality of the finished sheet and most difficult to remove prior to rolling. Often the mill scale is rolled into the slab by the multi-stand continuous mill. Ordinarily, mill scale can be removed by the aggressive application of high pressure water sprays. However, with the 2 inch (5.1 cm) thick slab, such sprays will tend to quench the steel to an unacceptable temperature for rolling, defeating the reheating process. On the other hand, a 5 inch (12.7 cm) slab as in the present invention is, of course, less than half the length and has less than half of the exposed surface and accordingly less of a buildup of scale. Further, this scale can be easily removed by the high pressure water sprays without affecting the slab temperature due to the reservoir of heat energy inside the 5 inch (12.7 cm) slab as discussed hereinafter.

As with the 2 inch (5.1 cm) thick slab, during the casting process external cooling is used to create a solid shell to contain the liquid core, which is essentially at the tundish temperature of 2,800° F. (1,538° C.). As the shell builds up, the liquid core is consumed and the slab becomes solid through its thickness. This established the metallurgical length of the caster. For a 5 inch (12.7 cm) slab, there is a temperature gradient from the center of the slab (2,600° F. (1,426° C.) to 2,800° F. (1,538° C.)) to the surface. If the slab is now put into an isothermal enclosure, the high internal temperature gradient that was necessary to remove the solidification enthalpy, provides sufficient thermal energy to affect a mean slab body temperature of about 2,000° F. (1,093° C.). Optionally, additional heat can be supplied to achieve a higher rolling temperature. This equalization process, in the isothermal enclosure, is immediately after the cast slab has solidified and is cut to length prior to the entry into the furnace.

The time required to do this is determined by the square of the distance the heat must diffuse (at most, half the slab thickness) and the thermal diffusivity of the solidified mass. Because the mean body temperature before equalization was higher than the mean body temperature after equalization, there is an excess enthalpy in the steel. This heat energy can be used to maintain the integrity of the isothermal enclosure, that is, compensate for losses associated with establishing the isothermal environment within the enclosure and accordingly, little or no external heating of the enclosure is required.

One of the advantages of this invention is the lower electric power costs of the subject invention as compared to the 2 inch (5.1 cm) thick caster/continuous rolling mill as previously described and similar processes. The peak power surges (19,000 kilowatts) of the multi-stand continuous rolling mill of the thin slab caster is significantly less than the peak for the pair of reversing mills of this invention. Since the power company's billing contract consists of two parts—"demand" and "consumed power", it is the "demand" portion that is the most costly when the process requires high peak loads over a short period of time. High demand equates to higher power costs.

Additionally, and perhaps of more importance, is the fact that many power companies cannot provide for the high peak loads due to the limits of generator and line capacity. This is of particular concern to emerging countries where the power grids are weak and the transmission lines are long. This invention is directed to solving this problem, by providing emerging countries with a low capital cost productive mini-mill steel plant compatible with their present power systems and existing infrastructure.

Even in sophisticated systems where demand gets averaged over say 15 minute intervals, the demand for a four to six stand continuous finishing mill receiving a 2 inch (5.1 cm) slab is still substantially greater than for a pair of hot reversing mills receiving a 5 inch (12.7 cm) slab.

Figure 2:
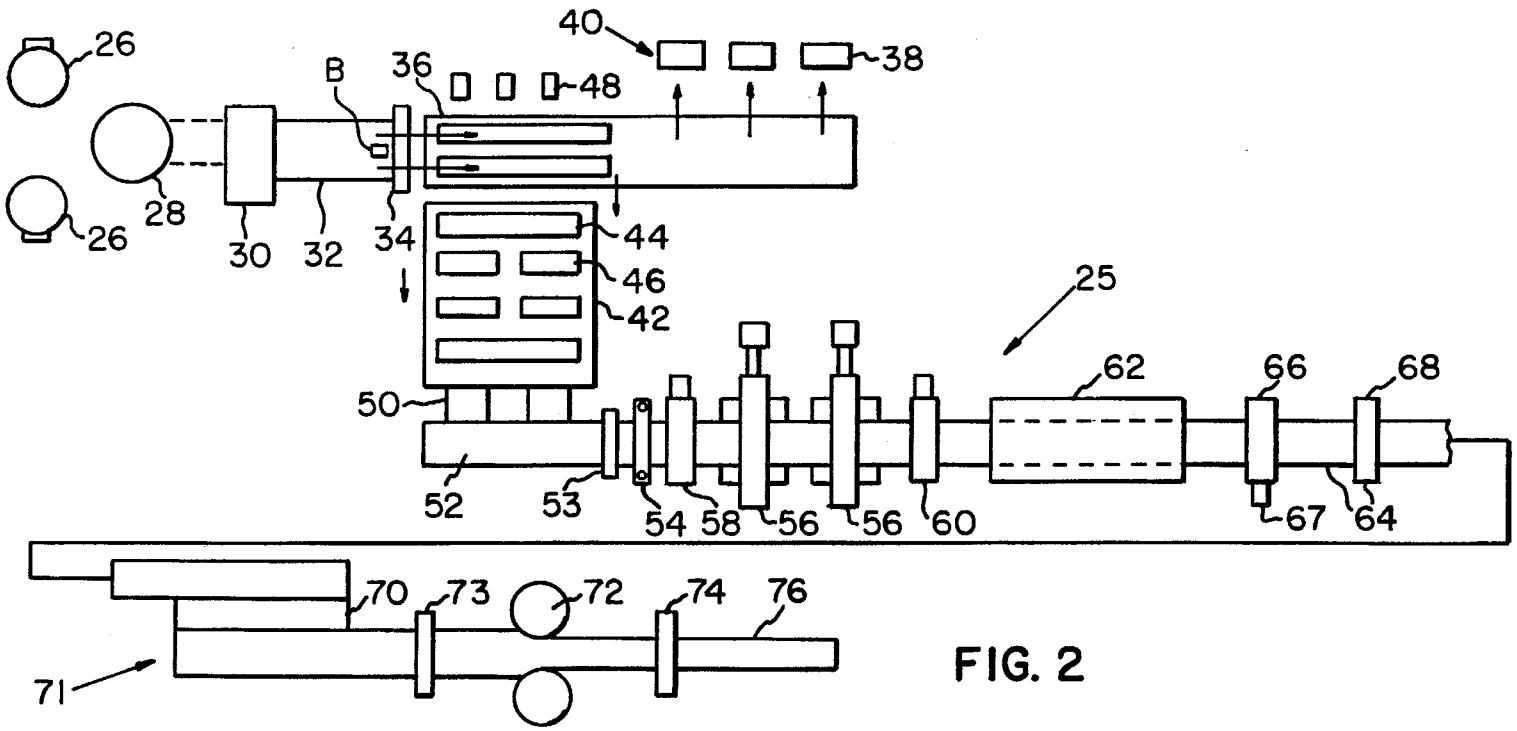
FIG. 2 is a schematic drawing illustrating the intermediate thickness strip twin caster and inline tandem hot reversing mills and coiler furnace arrangement according to the present invention.

The intermediate thickness slab caster and inline hot strip and plate line of the present invention is illustrated in FIG. 2. One or more electric melting furnaces 26 provide the molten metal at the entry end of our combination caster and strip and plate line 25. The molten metal is fed into a ladle furnace 28 prior to being fed into the twin caster 30. The twin caster 30 feeds into an adjustable caster mold (curved or straight) 32 of rectangular cross section. The caster mold 32 has a mold opening of about 125 inches (318 cm) and is configured to receive a 5 inch (12.7 cm) water cooled copper block therein to thereby cast two parallel strands. Without the block, the mold 32 can cast a single strand between 24 inches (61 cm) and 125 inches (318 cm) in width, although 120 inches (305 cm) may represent an upper limit due to the width capacity of other elements in the system. While the mold can cast widths as narrow as 24 inches (61 cm), the more conventional minimum product width is on the order of 35 inches (88.9 cm). The block need not be placed in the center of the mold 32 so that the two strands may be of equal or unequal width having a total width of up to 120 inches (305 cm).

A torch cutoff (or shear) 34 is positioned at the exit end of the mold 32 to cut the strand or strands of now solidified metal into a plurality of 3.5 inch (8.9 cm) to 5.5 inch (14 cm) thick slabs of the desired length which also has a width of 24 inches (61 cm) to 120 inches (305 cm).

The slab then feeds on a table conveyor 36 to a slab takeoff area where it is directly charged into a furnace 42 or is removed from the inline processing and stored in a slab collection and storage area 40. The preferred furnace is of the walking beam type although a roller hearth furnace could also be utilized in certain applications. Full size slabs 44 and discrete length slabs 46 for certain plate products are shown within walking beam furnace 42. Slabs 38 which are located in the slab collection and storage area 40 may also be fed into the furnace 42 by means of slab pushers 48 or charging arm devices located for indirect charging of walking beam furnace 42 with slabs 38. It is also possible to charge slabs from other slab yards or storage areas. Because the intermediate thickness slabs retain heat to a much greater extent than the thin slabs, temperature equalization is all that is required in many modes of operation. Of course, where slabs are introduced from off-line locations, the furnace must have the capacity to add Btu's to bring the slabs up to rolling temperatures.

The various slabs are fed through the furnace 42 in a conventional manner and are removed by slab extractors 50 and placed on a feed and run back table 52. Descaler 53 and/or a vertical edger 54 can be utilized on the slabs. This is another advantage of the present invention because vertical edger normally could not be used with a slab of only 2 inches (5.1 cm) or less.

Downstream of feed and run back table 52 and vertical edger 54 is a pair of tandem hot reversing mills 56 having an upstream and a downstream coiler furnace 58 and 60, respectively, on either side of the pair of mills 56. Cooling station 62 is downstream of coiler furnace 60. Downstream of cooling station 62 is a coiler 66 operated in conjunction with a coil car 67 followed by a plate table 64 operated in conjunction with a shear 68. The final product is either coiled on coiler 66 and removed by coil car 67 as sheet in strip or coil plate form or is sheared into plate form for further processing inline. A plate product is transferred by transfer table 70 which includes a cooling bed onto a final processing line 71. The final processing line 71 includes a plate side shear 72, plate end shear 74 and plate piler 76. A cut to length line can be employed to cut discreet plate.

The advantages of the subject invention come about as the result of the operating parameters employed. The selectively cast single strand or pair of strands should have a thickness between 3.5 inches (8.9 cm) to 5.5 inches (14 cm), preferably about 5 inches (12.7 cm) thick. The width can generally vary between 24 inches (61 cm) and 120 inches (305 cm) to produce a product up to 1,000 PIW (17.9 kg per mm) and higher.

The slab after leaving walking beam furnace 42 is flat passed back and forth through the pair of hot reversing mills 56 working in tandem in a minimum number of passes, such as four, achieving a slab thickness sufficient for coiling (i.e., about 1 inch (2.5 cm)or less). With the pair of mills 56, each passage of the slab between the coiler furnaces 58 and 60 results in two passes. The intermediate product of about 1 inch (2.5 cm) or less is then coiled in the appropriate coiler furnace, which in the case of four flat passes would be upstream of coiler furnace 58. Thereafter, the intermediate product is passed back and forth through the pair of hot reversing mills 56 and between the coiler furnaces 58 and 60 to achieve the desired thickness for the sheet in coil form, the coil plate or the plate product. The number of passes to achieve the final product thickness may vary but normally may be done in ten passes which include the initial flat passes. For example, a final product thickness of 0.10 inch (0.254 cm) may be done in ten passes while a final product thickness of 0.04 inch (0,102 cm) may be done in about fourteen passes. On the final two passes, which normally originate from upstream coiler furnace 58, the strip of the desired thickness is rolled in the pair of hot reversing mills and continues through the cooling station 62 where it is appropriately cooled for coiling on a coiler 66 or for entry onto a plate table 64. If the product is to be sheet or plate in coil form, it is coiled on coiler 66 and removed by coil car 67. If it is to go directly into plate form, it enters plate table 64 where it is sheared by shear 68 to the appropriate length. The plate thereafter enters a transfer table 70 which acts as a cooling bed so that the plate may be finished on finishing line 71 which includes descaler 73, side shear 72, end shear 74 and piler 76. An accelerated cooling system can be included inline with or as part of the standard laminar flow cooling to minimize or eliminate the need for the cooling bed.

The following Example illustrates the wide range of products that can be produced. It should be noted that the entry temperature into the rolling mill is necessarily higher (2,300° F. (1,260° C.)) for the wider slabs than for the more narrow product widths (about 2,000° F. (1,093° C.)) which more narrow widths in most facilities would represent the bulk of the product requirements.

EXAMPLE 1

A 60 inch (152.4 cm) wide×0.100 inch (0.254 cm) thick sheet in coil form is produced from a 5 inch (12.7 cm) slab of low carbon steel in accordance with the following rolling schedule:

ROLLING SCHEDULE FOR TWO STAND TANDEM REVERSING HOT STRIP MILL

| PRODUCT DATA | | SLAB DATA | |
|---|---|---|---|
| Width- | 60" | Width- | 60" |
| Thickness- | .100" | Thickness- | 5" |
| Length- | 2944 Ft. | Length- | 58.9 Ft. |
| PIW- | 1000 | Temp.- | 2300° F. |
| Coil Weight- | 30 Tons | Grade- | Low Carbon |

| Pass No. | Mill Stand Name | Gauge In. | % Red | Bite Angle Deg. | Draft in. | Length ft. | Mill Speed FPM Thread | Mill Speed FPM Roll | Roll Time sec. | Delay Time sec. | Elapsed Time sec. | Dancate Yes or No |
|---|---|---|---|---|---|---|---|---|---|---|---|---|
| 0 | FCE: | 5.0000 | .0 | .00 | .000 | 58.9 | .0 | .0 | .00 | .00 | .00 | No |
| 1 | 1F1: | 3.7000 | 26.0 | 17.37 | 1.300 | 79.6 | 324.3* | 318.9* | 9.20 | .00 | 9.20 | Yes |
| 2 | 1F2: | 2.4000 | 35.1 | 17.37 | 1.300 | 122.7 | 500.0* | 800.0* | 9.20 | 3.50 | 15.29 | No |
| 3 | 1F2: | 1.3750 | 42.7 | 15.41 | 1.025 | 214.1 | 300.0* | 900.0* | 24.80 | .00 | 40.09 | Yes |
| 4 | 1F1: | .8250 | 40.0 | 11.20 | .550 | 356.9 | 500.0* | 1500.0 | 22.93 | 3.50 | 44.52 | No |
| 5 | 1F1: | .4580 | 44.5 | 9.21 | .367 | 642.9 | 318.8* | 1275.1* | 43.34 | .00 | 87.86 | Yes |
| 6 | 1F2: | .2920 | 36.2 | 6.19 | .166 | 1008.4 | 500.0* | 2000.0 | 41.36 | 3.50 | 92.02 | No |
| 7 | 1F2: | .2085 | 28.6 | 4.39 | .083 | 1412.2 | 359.7* | 1798.6 | 62.36 | .00 | 154.38 | No |
| 8 | 1F1: | .1500 | 28.1 | 3.67 | .058 | 1963.0 | 500.0* | 2500.0 | 60.50 | 3.50 | 158.35 | No |
| 9 | 1F1: | .1176 | 21.6 | 2.73 | .032 | 2303.8 | 425.2* | 2125.9 | 72.64 | .00 | 230.99 | No |
| 10 | 1F2: | .1000 | 15.0 | 2.01 | .018 | 2944.5 | 500.0* | 2500.0 | 70.67 | .00 | 230.99 | No |

| Pass No. | Mill Stand Name | Gauge In. | Entry Temperature Deg. F. | Exit Temperature Deg. F. | Roll Force lb × 10**6 | Torque lb-ft × 10**6 | Horse Power | Load Ratio | RMS Time sec. |
|---|---|---|---|---|---|---|---|---|---|
| 0 | FCE: | 5.0000 | 2300.0 | 2300.0 | .0000 | .0000 | 0. | .0000 | .00 |
| 1 | 1F1: | 3.7000 | 2257.4 | 2245.5 | 2.6914 | .9614 | 12731. | 1.4293 | 18.91 |

-continued

| | | | | | | | | | |
|---|---|---|---|---|---|---|---|---|---|
| 2 | 1F2: | 2.4000 | 2240.9 | 2244.5 | 3.1851 | 1.1359 | 23190. | 1.6888 | 26.32 |
| 3 | 1F2: | 1.3750 | 2150.3 | 2149.9 | 3.6551 | 1.2119 | 27633. | 1.6017 | 76.11 |
| 4 | 1F1: | .8250 | 2146.1 | 2156.4 | 3.2415 | .7469 | 28391. | 1.2764 | 35.96 |
| 5 | 1F1: | .4580 | 2133.4 | 2048.0 | 3.9282 | .7340 | 23884. | 1.0912 | 50.88 |
| 6 | 1F2: | .2920 | 2014.2 | 2008.4 | 5.1308 | .3886 | 19835. | .8855 | 30.50 |
| 7 | 1F2: | .2085 | 1857.0 | 1864.4 | 2.9536 | .2559 | 11744. | .5243 | 14.69 |
| 8 | 1F1: | .1500 | 1836.8 | 1865.1 | 1.8790 | .2052 | 13091. | .5814 | 19.46 |
| 9 | 1F1: | .1176 | 1790.8 | 1757.9 | 2.6673 | .1368 | 7420. | .3313 | 7.49 |
| 10 | 1F2: | .1000 | 1712.5 | 1677.2 | 2.2102 | .0801 | 5110. | .2281 | 3.12 |

| | | |
|---|---|---|
| Reversing Tandom Mill RMS Production: | 467.52 | 1PH |
| Reversing Tandom Mill Peak Production: | 467.52 | 1PH |
| Coiling Begins at Pase Number: | 4* | 1F1* |
| Distance Between CFce #1 and Mill: | 27.00 | ft. |
| Distance Between Mill and CFce #2: | 27.00 | ft. |
| Coiling Furnance Diameter: | 54.00 | in. |
| Coiling Furnance Temperature: | 1750.00 | Deg. F. |
| Acceleration/Deceleration Rate: | 250.00 | FPM/sec |
| Final Temperature at: | 1677.17 | Deg. F. |

*After Bite Angle means Bite at or above 18 deg.
*After a Speed means Speed is below Base Speed.
*After Front Time means Time was Manually Entered Tandom Passes The system of the present invention is capable of producing a wide range of hot rolled sheet and plate products in coils which consist of a series of "process units" that efficiently convert the initial feed stock (scrap steel or molten steel) into sheet steel and plate in coils. Each of these "process units" has different characteristics that affect the total rate of production of the process. The ultimate product capability, which is so vital for a successful marketing strategy, is determined by the desired production level for each product (product mix) and by the individual characteristics of each "process unit".

Figure 3A:
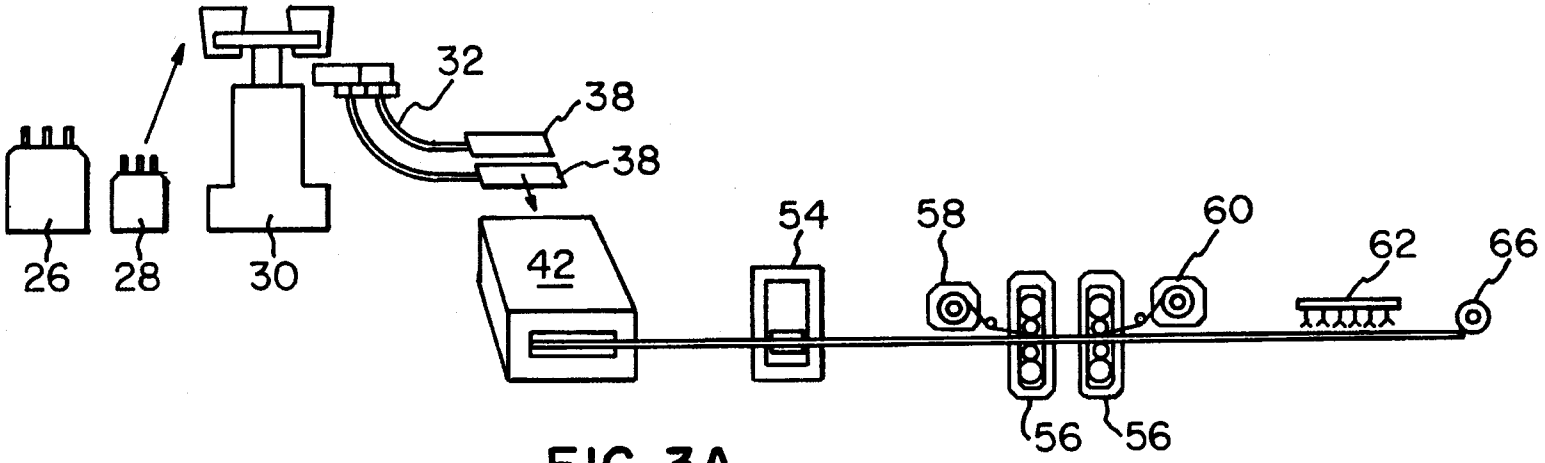
Figure 3B:
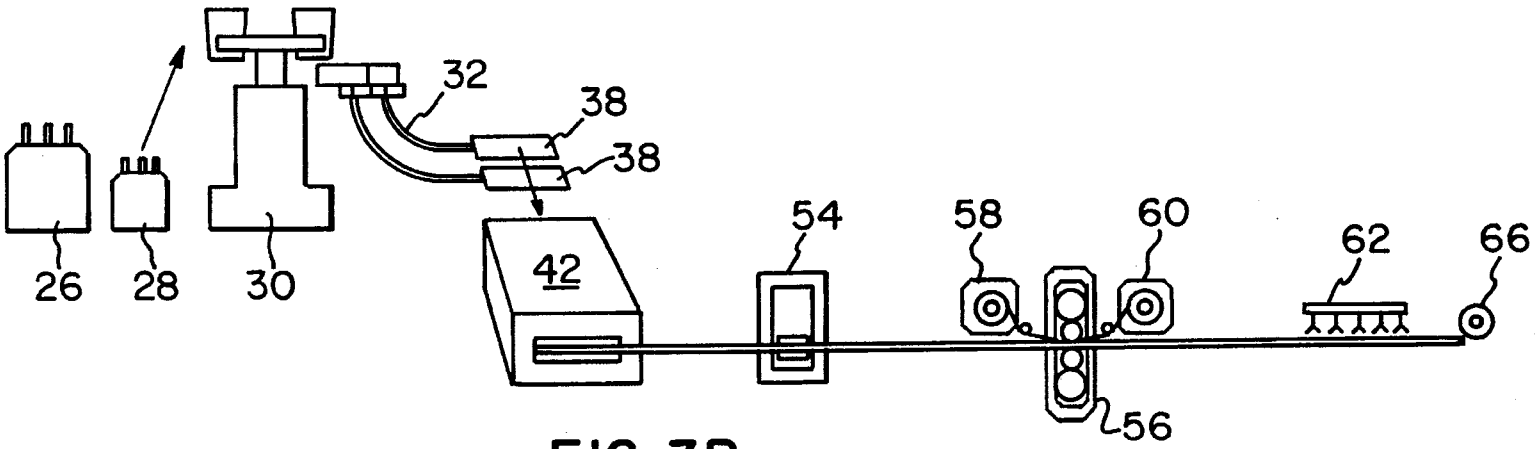
Figure 3G:
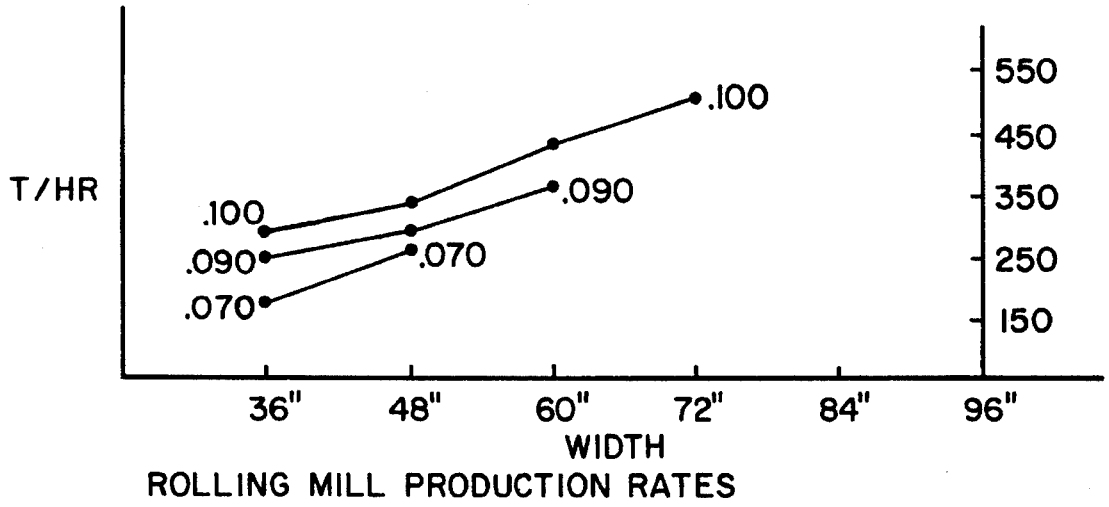

The mini hot strip mill facility of the present invention for producing a wide range of hot rolled sheet and plate products in coils consists of a series of "process units" that converts the initial feed stock (scrap steel or molten steel) into sheet steel and plate in coils. Each of these "process units" has different characteristics that affect the total rate of production of the process. FIGS. 3A–3C schematically illustrate the process flow of various embodiments of the present invention, and FIGS. 3D–3G graphically show the process variability of each process unit. The ultimate product capability, which is so vital for a successful marketing strategy, is determined by the individual characteristics of each "process unit" and, of course, by the desired production level for each product (product mix). FIG. 3D illustrates four different steelmaking capacities each representing a different level of capital expense. FIG. 3E illustrates the linear relationship between width of the cast slab and caster production rate. The caster production rate, of course, cannot exceed the associated liquid steel production rate. FIG. 3F illustrates four different furnace capacities each representing a different level of capital expense. As with the liquid steel production rates shown in FIG. 3D, the furnace capacities do not vary with slab width. FIG. 3G illustrates the rolling mill production rates for the twin tandem mill of FIG. 3A for various thicknesses of product at varying widths. One of the purposes of FIGS. 3A–3G above is to illustrate the interdependence of the various process units in the material flow from scrap to finished steel. Ideally, it is the goal of all steel plant entrepreneurs to have all process units equally rated for the highest practical level of production throughout.

However, it is more likely that one or two of the units will set the production level due to its throughput limit, technology and capital costs. For example, of two existing "thin slab" (2 inches (5.1 cm)) hot strip mill facilities, one 53 inch (134.6 cm) wide mill is operating at Crawfordsville, Ind. at a rate of 800,000 tons per year, and the other a 61 inch (154.9 cm) wide mill at Hickmann, Ark. is operating at a rate of about 1 million tons per year. In order to increase the output of each plant to about 2 million tons per year, it has been proposed to install a second complete electric furnace, ladle furnace, caster, tunnel furnace and baghouse complex at each plant. This expansion virtually includes everything except the rolling mill. Obviously, the 2 inch (5.1 cm) thick slab casting and continuous hot strip mill technology is very expensive to implement, particularly when production in excess of 1 million tons per year is required.

On the other hand, as described herein, the technology of the present invention will provide the opportunity for the businessman to build the mini-mill in accordance with the production levels set forth in his business plan, rather than to be limited by the low throughput rate of the caster or any other process unit. Therefore, one basic concept of the present invention can be applied to mini-steel plants with initial production capacities as low as 500,000 tons per year and as high as 2 million tons per year or higher.

Figure 4:
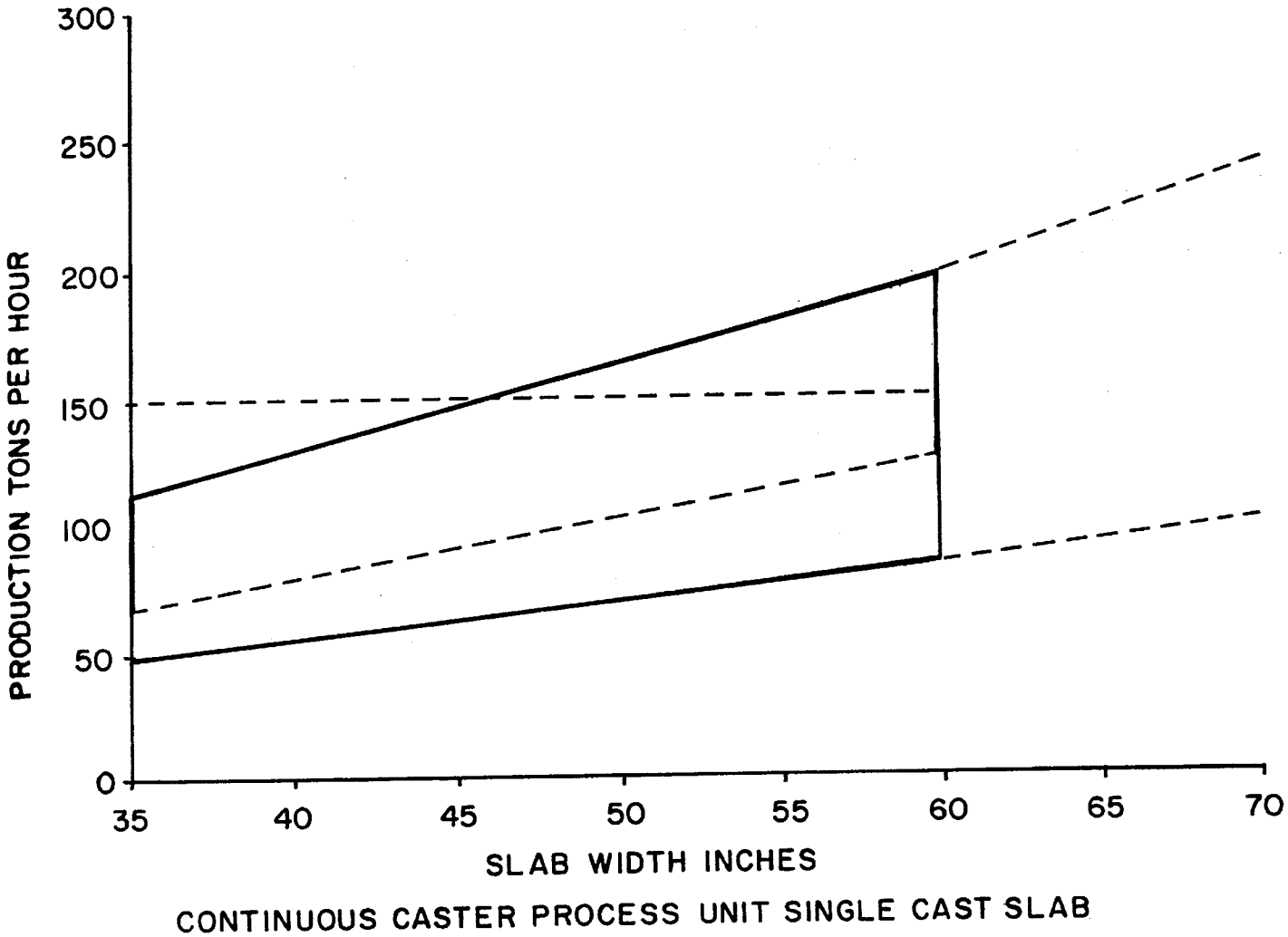
FIG. 4 is a production graph for a conventional 60 inch (152.4 cm) wide single slab caster.
Figure 5:
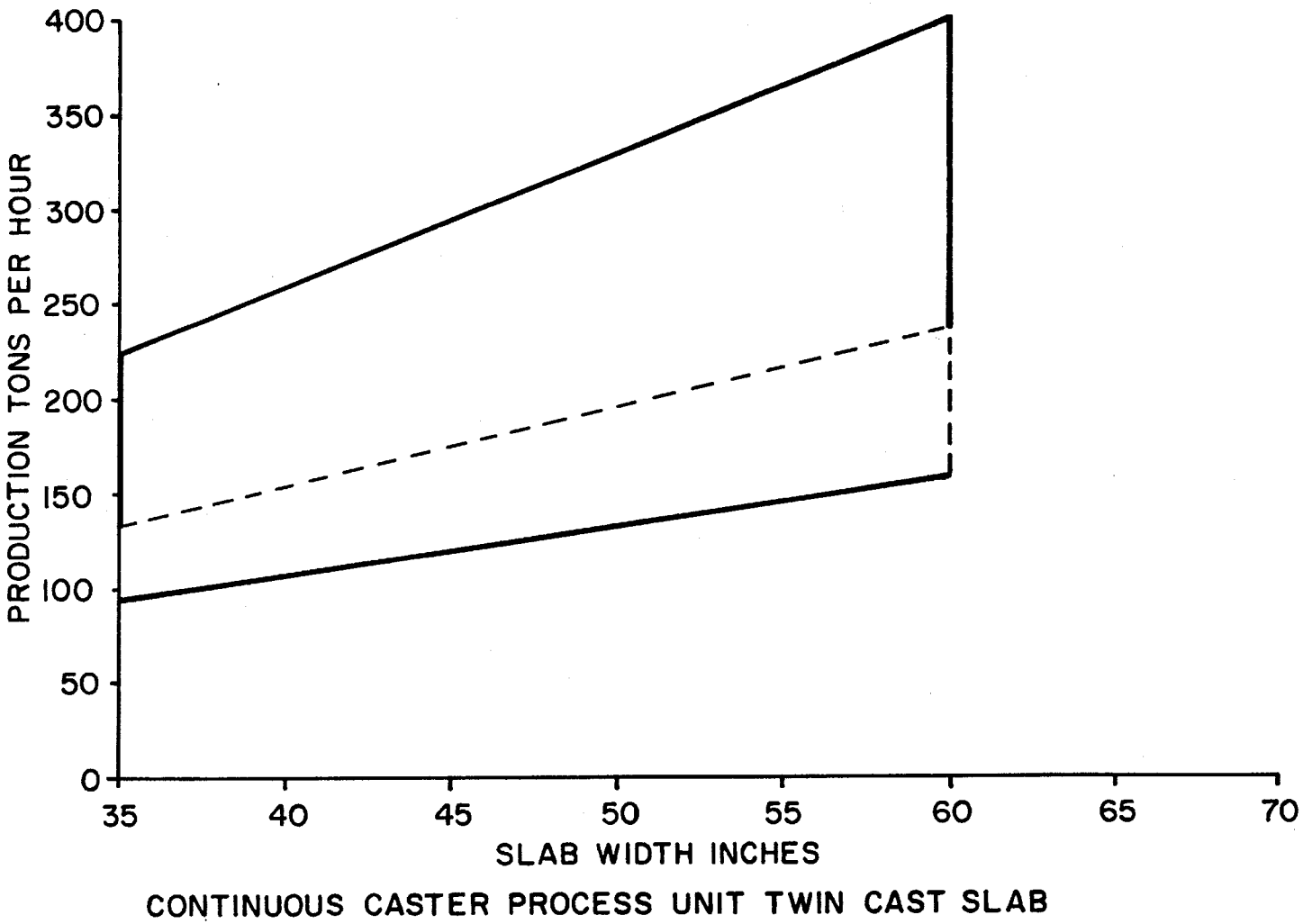
FIG. 5 is a production graph for the twin slab caster of the present invention casting identical width slabs.

The production of the caster is determined by the thickness and width of the slabs as well as by the maximum and minimum casting speeds. FIG. 4 graphically illustrates the caster domain for producing up to 60 inch (152.4 cm) wide, 5 inch (12.7 cm) thick slabs. The 5 inch (12.7 cm) thick slab was selected instead of a 4 inch (10.2 cm) thick slab to increase the production from the caster with virtually no loss of production by the rolling mill. The casting speeds have been set at conservative levels between 32 inches per minute (81.3 cm per minute) to 79 inches per minute (200.7 cm per minute), respectively, to help assure the highest quality slabs are produced. It should be appreciated that production will increase with advances in casting speeds which allow faster casting speeds while maintaining desired quality. As illustrated in FIG. 5, the parallel horizontal lines that are superimposed on the caster domain chart illustrate the various production rates that can be accommodated by the caster for various products. Attention is also called to the shaded area on FIG. 4 which delineates the domain for casting high carbon steels and alloy steels, such as stainless, which require slower casting rates than conventional steels and cannot be properly cast with a 2 inch (5.1 cm) high speed caster. Illustrated in FIG. 4 is the 150 ton per hour liquid steel supply to the caster, as shown by the dotted horizontal line. This level of liquid steel is perhaps the most practical level for the single cast slab and a standard product mix.

When casting 36 inch (91.4 cm) wide slabs, the caster production would be limited to about 125 tons per hour. When casting 60 inch (152.4 cm) wide slabs, the caster would be operating at 150 tons per hour in spite of the fact that the caster can accept a higher rate.

However, the 150 tons per hour rate may not be high enough to meet the projected marketing strategy and business goals. To solve this problem, and to increase the caster flexibility, attention is directed to FIG. 5 which shows the operating domain of a 60 inch (152.4 cm) wide "twin cast" casting machine, according to the present invention, for the same 5 inch (12.7 cm) thick slabs. The "twin cast" machine casts two 5 inch (12.7 cm) thick slabs each up to 60 inches (152.4 cm) wide in parallel through the machine at the same time which, of course, doubles the single cast production rate and, most importantly, has the same cast structure and solidification rate (metallurgical length) as the single strand caster. The "twin cast" solution now meets the goal of higher production at a small incremental cost. To do this, as discussed above, the caster is designed and provided with a 125 inch (318 cm) wide mold with a 5 inch (12.7 cm) water cooled copper dividing block which is generally, but not necessarily, positioned in the center of the mold to provide two slabs of the same width.

FIG. 5 shows the product domain of the "twin cast" arrangement with the dividing block positioned on the centerline of the mold to produce two slabs of equal width. For example, two 60 inch (152.4 cm) wide, two 50 inch (127 cm) wide and two 40 inch (101.6 cm) wide. However, as seen in FIG. 5, the casting rate in tons per hour for the above widths decreases as the slabs become narrow since the total width of the two slabs is less than 120 inches (305 cm). If however, the dividing block is set "off center" then for slabs of different widths that total 120 inches (305 cm) wide, the caster production rate stays at the highest level as shown, of 400 tons per hour. Such slab width combinations include the following: 48 inches (121.9 cm) and 72 inches (182.9 cm); 40 inches (101.6 cm) and 80 inches (203.2 cm); 36 inches (91.4 cm) and 84 inches (213.4 cm); and 24 inches (61 cm) and 96 inches (244 cm).

Further, since the caster mold is equipped with adjustable width mechanisms, the widths of the mold can be set for less than the 120 inch (305 cm) dimensions so that two slabs of different widths (with an "off center" block) can be cast at higher rates than the casting rates for 36 inch (91.4 cm) and 48 inch (121.9 cm) wide slabs, as shown in FIG. 5.

The "twin cast" solution unquestionably solves the production limitation problems for most cast products. However, it is, of course, unlikely that a liquid metal supply of 400 tons per hour would ever be installed but, as shown in FIG. 5, the caster can be operated at various levels, say 200, 250, 300 and 350 tons per hour, for those products which otherwise could only be cast at much lower rates. Now, since the present invention has supplied a caster than can cast up to 120 inch (305 cm) wide slabs (as one or two slabs as desired), we can now extend the product domain of the caster to include slabs for wider sheet and plate products as well as the high tons per hour for 60 inch (152.4 cm) wide and less sheet products.

Figure 6:
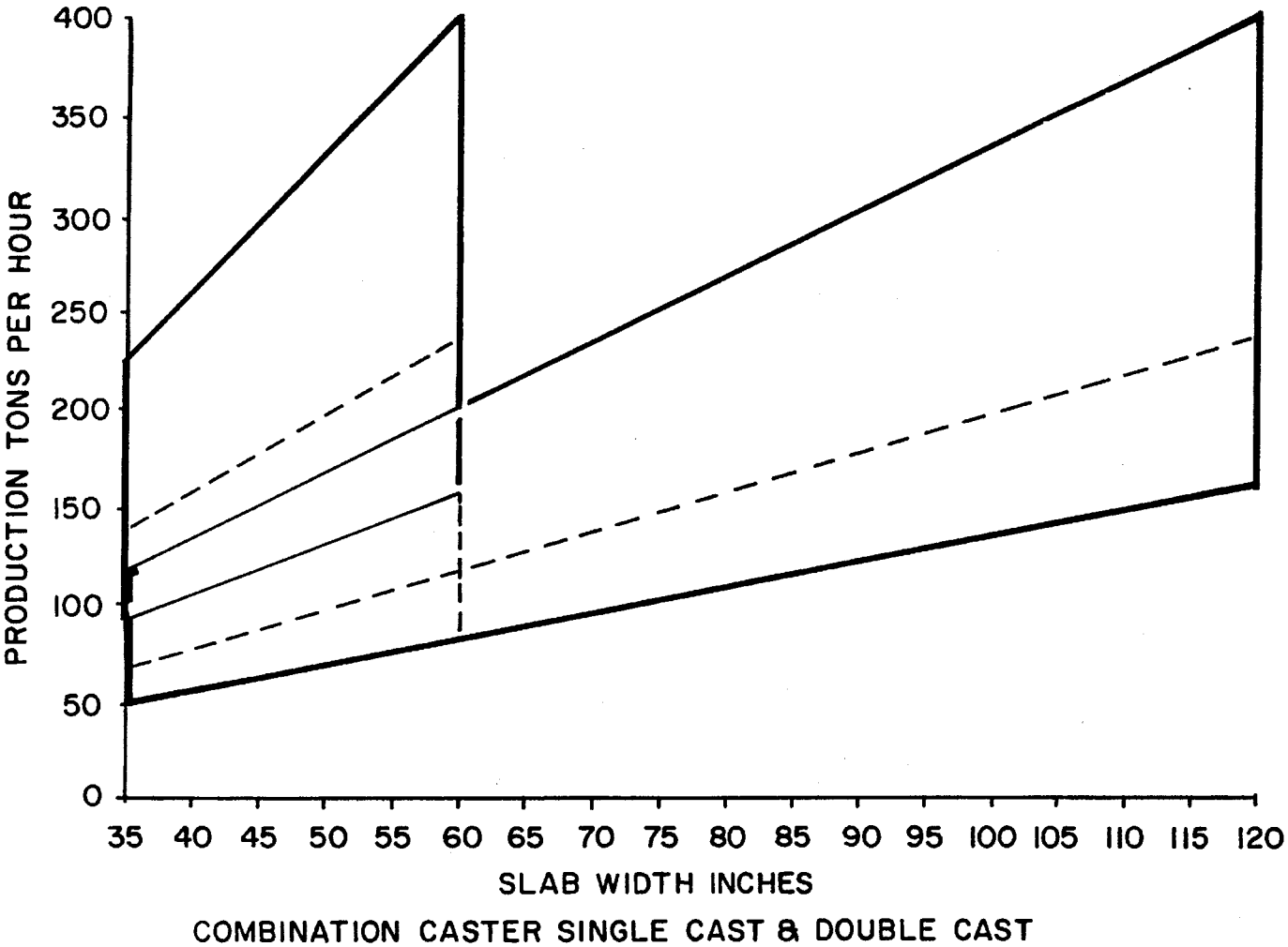
FIG. 6 is a production graph for the twin caster according to the present invention.

The combination caster domain illustrated in FIG. 6 indicates, by the heavy black lines, the boundary limits of the product domain for the 5 inch (12.7 cm) thick slab for the present invention. Now, again, the various levels of production can be applied to the domain illustrated in FIG. 6 to finally understand and exploit the opportunities of the combination continuous casting machine of the present invention. For example, when supplying the combination caster with molten steel from the electric furnace shop or BOF at a production level of 200 tons per hour, the caster would operate in the "twin cast" mode for casting slabs in the width range from 35 inches (88.9 cm) to 60 inches (152.4 cm). It could then be converted back to the "single cast" mode for casting from 60 inch (152.4 cm) to 120 inch (305 cm) wide slabs.

The justification for the wide caster that can cast to 120 inches (305 cm) wide, is supported by the outstanding benefits of the high production capability of the "twin cast" mode in the 35 inch (88.9 cm) to 60 inch (152.4 cm) width range. With the exception of some additional costs related to the rolling mill, the opportunity to substantially increase the facility's product domain range to include wide coil plate products up to 120 inches (305 cm) (such as, for example, high strength low alloy, ABS ship grade steel, pipe steels, etc.) will directly affect the market penetration and profitability of the business enterprise. In effect, the wide coiled plate capability is available virtually for free. The stage has now been set to address the design parameters of the rolling mill that will efficiently convert the various slabs from the combination caster into finished sheet and coiled plate product.

FIGS. 3A–3C show alterative rolling mill designs that can be applied to the mini-mill facility. The mill shown in FIG. 3B is a single stand reversing hot strip mill according to the present invention. The mill shown in FIG. 3A is the two stand tandem reversing hot strip mill discussed in greater detail above in connection with FIG. 2. The twin mill of FIG. 3A will provide a substantial increase in production capability over the single stand facility of FIG. 3B. The twin caster arrangement could also be utilized with a multi-stand continuous hot strip mill, as shown in FIG. 3C, for use in conjunction with the so-called thin slabs as well. Attention is called to rolling schedules for two stand tandem reversing hot strip mills for producing 60 inch (152.4 cm) wide sheet to 0.100 inch (0.254 cm) thickness attached to the example above. The operation proceeds as follows:

A 5 inch (12.7 cm)×60 inch (152.4 cm) wide slab is removed from the equalizing furnace and passes through a vertical edging mill (for one or three passes), and high pressure water descale box, and onto the No. 1 stand of the rolling mill where the slab is reduced to 3.7 inches (9.40 cm) in the first pass. The slab enters No. 2 stand and is rolled to 2.63 inches (6.68 cm) and is run completely out of No. 2 stand onto the following mill table. The slab is reversed, to return through both mill stands, No. 2, then No. 1, to be reduced to 1.74 inches (4.42 cm) and then 1.02 inches (2.59 cm) to enter into the front coiling furnace and be wound on the coiling drum. At this point, the slab has been reduced to a 1.02 inch (2.59 cm) thickness in four passes, which is within the thickness range (1.2 inches (3.05 cm) to 0.5 inch (1.27 cm)) desired for entering the drum of the coiling furnace. Additionally, the sheet bar is almost totally coiled on the drum, inside the furnace, and, accordingly, the rate of heat loss due to radiation is greatly reduced so that the workpiece can retain heat energy to allow the process to continue. The mill is reversed and the sheet bar passes again through stand No. 1 and No. 2 and is coiled on the down side coiler in the same manner. The tailing end of the strip is always passed through the mill bite and retained by a pinch roll unit (not shown) located between the mill and the coiling furnace so it does not get drawn into the coiling furnace. Additionally, the pinch rolls also feed the strip back into the roll bite for the next pass through the mills. This rolling process can continue for as many passes necessary to finish the strip product. With the two stands in tandem, the production rate of the mill is virtually doubled to 471 tons per hour. The speed, torque and horsepower of the tandem mill motor are determined by an analysis of the projected product mix.

The following Charts, A and B, set forth the typical adjusted rolling rates in tons per hour for various standard widths and standard product thicknesses for both the two stand tandem reversing hot strip mill of FIGS. 2 and 3A (Chart A) and the single stand reversing hot strip mill of FIG. 3B (Chart B). These charts are used to develop the overall caster/rolling mill production capability with any specific product mix. They can also be used to develop a sensitivity analysis by changing the mix and/or the liquid steel supply. For example, Chart C shows the analysis of the combination twin caster with a 96 inch (244 cm) wide two stand tandem reversing hot strip mill of FIGS. 2 and 3A with the following product mix:

36 inches (91.4 cm) wide - 150,000 tons 48 inches (121.9 cm) wide - 250,000 tons 60 inches (152.4 cm) wide - 450,000 tons 96 inches (244 cm) wide - 150,000 tons For a total of - 1,000,000 tons/year Chart C uses 1 million tons as the "base" to establish a factor to apply to the 1 million ton production to seek the maximum tonnage with this mix. As illustrated in FIGS. 5 and 6, the maximum twin cast rate for 36 inches (91.4 cm) wide is 236 tons per hour, and for 48 inches (121.9 cm) wide it is 320 tons per hour, and for 60 inches (152.4 cm) wide the maximum rate is 400 tons per hour; however, in this case, the liquid steel supply may be limited to 350 tons per hour. As discussed above, the twin cast domain of FIGS. 5 and 6 shows casting of two equal width slabs. Of course, by offsetting the separating block, the caster output could be much higher, utilizing the maximum rate of the liquid steel supply. This approach would require rolling a "wide - narrow - wide" sequence of slabs on the rolling mill which actually could be beneficial in distributing roll wear for longer rolling periods between roll change. Nevertheless, for the present explanatory purpose, this example will proceed with the equal width domain of FIGS. 5 and 6.

When using the production Chart A for a two stand rolling mill, the tons per year is divided for each specific product by the lower of the caster rate or the rolling mill rate, so the hours per year required to produce these products can be obtained. As can be seen, the rolling rates, in most cases, are in excess of the casting rates. It should be noted that with the 96 inch (244 cm) wide plate, Chart B is used to obtain the rolling rate for 0.187 inch (0.475 cm) and also for 0.250 inch (0.635 cm). Chart C shows that the 1 million tons can be produced in 3,235 hours. The following adjustments can now be applied:

| | |
|---|---|
| Days Per Year = 365 Minus 10 Day Holiday = | 355 |
| Utilization Rate = 80% | × .8 |
| Operating Hours Per Year = | 6,816 |
| Factor = Available Operating Hours Per Year | 6,816 |
| Hours Required Per 1,000,000 Tons | 3,235 |
| | 2.106 |
| Gross Production Tons Per Year = | 2,030,000 |
| Yield Loss = | × .96 |
| Caster | 2% |
| Rolling Mill | 2% |
| | = 96% |
| Approximate EAF Production Tons Per Year = | 2,021,760 Tons Per Year |

In review, as discussed above, each "process unit" in the manufacturing stream has an "operational limit" which will set the level of overall plant production as well as the product domain. These limits will accordingly affect plant efficiency, market position, profitability, capital cost and other elements of manufacturing expense. However, with the application of the concept of the present invention, with its combination caster in conjunction with the two stand reversing hot strip mill of FIGS. 2 and 3A, or the single stand reversing hot strip mill of FIG. 3B, or with a multi-stand continuous hot strip mill as shown in FIG. 3C, as each may apply, the entrepreneur has the opportunity to select the facility parameters based primarily on his business goals without the throttling effect of the various "process units" limiting the production flow.

Further, due to the unique product domain of our mini-mill facility, the entrepreneur can target a variety of sheet and coil plate niche products, which heretofore were extremely difficult and costly (and in some cases impossible) to manufacture via present technology. These specialty products, of course, will command higher prices and can be successfully marketed to manufacturers worldwide.

CHART A
Rolling Rates for Two Stand Tandem Reversing Hot Strip Mill
Standard Products - Tons Per Hour

| | WIDTH | | | | | | |
|---|---|---|---|---|---|---|---|
| THICKNESS | 36" 18 Ton Coil | 48" 24 Ton Coil | 60" 30 Ton Coil | 72" 36 Ton Coil | 84" 42 Ton Coil | 96" 45 Ton Coil | 120" 45 Ton Coil |
| .070 | 204 | 271 | | | | | |
| .090 | 224 | 298 | 373 | | | | |
| .100 | 277 | 336 | 420 | 508 | | | |
| .120 | 285 | 373 | 467 | 486 | | | |
| .187 | 318 | 424 | 532 | 603 | 676 | 768 | |
| .250 | 360 | 479 | 599 | 720 | | 831 | 1178 |
| .375 | | 714 | 701 | 841 | 706 | 993 | 1303 |
| .500 | | | 707 | 848 | 990 | 1112 | 1350 |

-continued

CHART A
Rolling Rates for Two Stand Tandem Reversing Hot Strip Mill
Standard Products - Tons Per Hour

| | WIDTH | | | | | | |
|---|---|---|---|---|---|---|---|
| THICKNESS | 36" 18 Ton Coil | 48" 24 Ton Coil | 60" 30 Ton Coil | 72" 36 Ton Coil | 84" 42 Ton Coil | 96" 45 Ton Coil | 120" 45 Ton Coil |
| .625 | | | | | | | |

CHART B
Rolling Rates for Single Stand Reversing Hot Strip Mill
Standard Products - Tons Per Hour

| THICK- | WIDTH | | | | | | |
|---|---|---|---|---|---|---|---|
| NESS | 36" | 48" | 60" | 72" | 84" | 96" | 120" |
| .070 | 97.2 | 130 | | | | | |
| .090 | 113 | 151 | 190 | | | | |
| .100 | 121 | 161 | 201 | 245 | | | |
| .120 | 165 | 219 | 274 | 333 | 390 | | |
| .187 | 209 | 279 | 348 | 418 | 413 | 462 | |
| .250 | 292 | 389 | 361 | 433 | 505 | 564 | 648 |

-continued

CHART B
Rolling Rates for Single Stand Reversing Hot Strip Mill
Standard Products - Tons Per Hour

| THICK- | WIDTH | | | | | | |
|---|---|---|---|---|---|---|---|
| NESS | 36" | 48" | 60" | 72" | 84" | 96" | 120" |
| .375 | | 448 | 533 | 639 | 568 | 633 | 720 |
| .500 | | 656 | 701 | 841 | 750 | 847 | 984 |
| .625 | | | | | | | 1027 |

CHART C

Production Analysis for Selected Product Mix
Twin Cast/Single Cast - Two Stand Tandem Reversing Hot Strip Mill
1,000,000 Tons/Year Base Case

| Thick- | 150,000 Tons | | 250,000 Tons | | 450,000 Tons | | 150,000 Tons | |
|---|---|---|---|---|---|---|---|---|
| ness | 36" Wide | 18 Ton Coils | 48" Wide | 24 Ton Coils | 60" Wide | 30 Ton Coils | 96" Wide | 45 Ton Coils |
| .070 | 50,000 Tons | Caster 236 / Mill 204 | | Caster / Mill | | Caster / Mill | | Caster / Mill |
| | 50,000 / 204 = | 245 Hours | | | | | | |
| .090 | 50,000 Tons | Caster 236 / Mill 224 | 100,000 Tons | Caster 320 / Mill 298 | 125,000 Tons | Caster 350 / Mill 373 | | |
| | 50,000 / 224 = | 224 Hours | 100,000 / 298 = | 335 Hours | 125,000 / 350 = | 357 Hours | | |
| .100 | 50,000 Tons | Caster 236 / Mill 277 | 150,000 Tons | Caster 320 / Mill 336 | 200,000 Tons | Caster 350 / Mill 420 | | |
| | 50,000 / 236 = | 211 Hours | 150,000 / 320 = | 468 Hours | 200,000 / 350 = | 571 Hours | | |
| .120 | | | | | 125,000 Tons | Caster 350 / Mill 420 | | |
| | | | | | 125,000 / 350 = | 357 Hours | SINGLE CAST | |
| .187 | | | | | | | 75,000 Tons | Caster 320 / Mill 767 |
| | | | | | | | 75,000 / 320 = | 234 Hours |
| .250 | | | | | | | 75,000 Tons | Caster 320 / Mill 831 |
| | | | | | | | 75,000 / 320 = | 234 Hours |
| | | 679 Hours | | 803 Hours | | 1285 Hours | 468 Hours | Total Hours 3235 |

Adjustments:

Days in year 365 minus holidays − 10

Factor = $\frac{6816}{3235} = 2.106 \times 1{,}000{,}000 = 2{,}106{,}000 \times .96$ CHART C-continued Production Analysis for Selected Product Mix
Twin Cast/Single Cast - Two Stand Tandem Reversing Hot Strip Mill
1,000,000 Tons/Year Base Case

| | | | |
|---|---|---|---|
| | 355 | | |
| Utilization 80% | × .8 | Yield = | Caster 98% |
| | 284 days | | Rolling Mill 98% |
| | × 24 | | Total = 96% |
| | 6816 hrs/yr | | |

Net Production
2,021,760 Tons/Year

While distinct embodiments of the present invention have been described herein, it will be readily apparent to those of ordinary skill in the art that various changes and modifications may be made to the present design without departing from the spirit and scope thereof. Consequently, the scope of the present invention is intended to be limited only by the attached claims.

We claim:

1. A method of making coiled plate, sheet in coil form or discrete plate comprising the steps of:

a) continuously casting at least one strand having an intermediate thickness;

b) severing said at least one strand into a plurality of slabs of predetermined length;

c) feeding each said slab into an inline heating furnace;

d) extracting said slab onto a continuous processing line including at least two hot reversing mills having a coiler furnace on each of an upstream side and downstream side of said hot reversing mills;

e) flat passing said slab back and forth through said plurality of mills to form an intermediate product of a thickness sufficient for coiling in a minimum number of passes through said mills;

f) coiling said intermediate product in one of said upstream or downstream coiler furnaces;

g) passing said coiled intermediate product at least once through said mills to reduce said coiled intermediate product to an end product of desired thickness, said intermediate product being collected in and fed out of each of said coiler furnaces on each pass through said mills; and h) finishing said end product into one of coiled plate, discrete plate or sheet in coil form.

2. The method of claim 1 wherein a pair of parallel strands are simultaneously cast.

3. The method of claim 2 wherein each of said pair of strands has a thickness of about 5 inches.

4. The method of claim 1 wherein a pair of tandem hot reversing mills is provided between said coiler furnaces.

5. The method of claim 1 including casting each said strand to a thickness of about 5 inches.

6. The method of claim 1 including reducing said slab to said end product in ten or less passes through said hot reversing mills.

7. The method of claim 1 wherein said finishing of said end product includes cooling said end product by passing it through an inline cooling station and thereafter coiling it on an inline coiler for removal as coiled plate or sheet in coil form.

8. The method of claim 1 wherein said finishing of said end product includes shearing inline to a plate of a discrete length, cooling said plate and finishing said plate through at least one of a side shear and end shear and a piler.

9. The method of claim 1 including casting a single strand having a width between 24 inches and 120 inches and a thickness of about 5 inches.

10. The method of claim 1 further comprising the step of removing slabs from a slab takeoff located downstream of the caster and adjacent said heating furnace when delays are encountered downstream of the furnace and storing said slabs in a storage area upstream of the furnace prior to charging said slabs into said furnace.

11. The method of claim 1 further comprising the step of passing said slab through a vertical edger prior to flat passing said slab.

12. A method of making coiled plate, sheet in coil form or discrete plate comprising the steps of:

a) selectively continuously casting either a single strand having an intermediate thickness and a width up to about 125 inches or a pair of strands each having an intermediate thickness and a total width of said pair of strands to about 120 inches;

b) shearing each said strand into a slab of predetermined length;

c) flat passing said slab back and forth through a pair of tandem hot reversing mills to form an intermediate product of a thickness sufficient for coiling, wherein said pair of tandem hot reversing mills has a coiling furnace on each of an upstream and downstream side;

d) coiling said intermediate product in one of said coiler furnaces;

e) passing said coiled intermediate product at least once between said coiler furnaces through said pair of tandem mills to reduce said coiled intermediate product to an end product of desired thickness; and f) finishing said end product into one of coiled plate, discrete plate or sheet in coiled form.

13. The method of claim 12 wherein said thickness of each said strand is about 5 inches.

14. The method of claim 12 wherein each said strand is cast at between 32 inches per minute and 79 inches per minute.

15. An intermediate thickness slab caster and inline hot strip and plate line comprising:

a) a continuous twin strip caster for forming either a single strand having a width up to about 125 inches or two parallel strands having a total width of said pair of strands up to about 120 inches;

b) an inline shear means for cutting each said strand to a slab of desired length;

c) a reheat furnace inline with said shear means;

d) a pair of tandem hot reversing mills inline with said reheat furnace for reducing each said slab exiting said reheat furnace to an intermediate thickness product sufficient for coiling;

e) a pair of coiler furnaces, one located upstream of said tandem hot reversing mills and the other downstream, said coiler furnaces capable of receiving and paying out said intermediate thickness product as it is passed between the coiler furnaces and through said tandem hot reversing mills as the product is being reduced to an end product thickness; and f) a finishing line downstream of and inline with said pair of coiler furnaces and said tandem hot reversing mills.

16. An intermediate thickness slab caster and inline hot strip and plate line comprising:

a) a continuous strip caster for forming at least one strand of an intermediate thickness;

b) inline shear means downstream of said caster means for cutting each said strand to a slab of a desired length;

c) a slab conveyor table inline with said shear means;

d) a reheat furnace having an entry end inline with said slab conveyor table for receiving slabs therefrom;

e) a feed and run back table positioned at an exit end of said reheat furnace;

f) a hot reversing mill means inline with said feed and run back table for reducing each said slab exiting said reheat furnace to an intermediate thickness product sufficient for coiling in a minimum number of flat passes, said hot reversing mill means including at least two hot reversing mills;

g) a pair of coiler furnaces, one located upstream of said hot reversing mill means and the other located downstream, said coiler furnaces capable of receiving and paying out said intermediate thickness product as it is passed between the coiler furnaces and through said hot reversing mill means so as to be reduced to an end product thickness; and h) a finishing line downstream of and inline with said pair of coiler furnaces and said hot reversing mill means.

17. The apparatus of claim 16 wherein said finishing line includes in sequence a cooling station, a downcoiler, a plate table, a shear, a cooling bed crossover and plate side and end shears and a piler.

18. An inline method of casting steel slabs and converting them into finished strip or plate product comprising the steps of:

a) simultaneously casting two strands from a single caster;

b) cutting each of said strands into a plurality of slabs of predetermined length;

c) feeding such slabs into an inline heating furnace;

d) extracting said slabs onto a continuous processing line including at least two reducing mills and a pair of coiler furnaces, one said coiler furnace positioned upstream of said two reducing mills and the other coiler furnace positioned downstream of said two reducing mills; and e) reducing said slabs into a product of desired thickness on said at least two reducing mills.

* * * * *

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Column 1 Line 34 "i million" should read --1 million--.

Column 4 Line 67 "(1,093+ C.)" should read --(1,093° C.)--.

Column 8 Line 7 "(0,102 cm)" should read --(0.102 cm)--.

Column 8, in the table entitled *Rolling Schedule For Two Stand Tandem Reversing Hot Strip Mill*, the furthest right-hand column heading, in the top half of the table, "Dancate" should read --Descale--.

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Columns 8-9, in the table entitled *Rolling Schedule For Two Stand Tandem Reversing Hot Strip Mill*, delete the second column in both the top half and the bottom half of the table which reads as follows:

"

| Mill Stand Name |
|---|
| FCE: |
| 1F1: |
| 1F2: |
| 1F2: |
| 1F1: |
| 1F1: |
| 1F2: |
| 1F2: |
| 1F1: |
| 1F1: |
| 1F2: |

| Mill Stand Name |
|---|
| FCE: |
| 1F1: |
| 1F2: |
| 1F2: |
| 1F1: |
| 1F1: |
| 1F2: |
| 1F2: |
| 1F1: |
| 1F1: |
| 1F2:" |

and insert therefor:

--

| Mill Stand Name |
|---|
| FCE: |
| TF1: |
| TF2: |
| TF2: |
| TF1: |
| TF1: |
| TF2: |
| TF2: |
| TF1: |
| TF1: |
| TF2: |

| Mill Stand Name |
|---|
| FCE: |
| TF1: |
| TF2: |
| TF2: |
| TF1: |
| TF1: |
| TF2: |
| TF2: |
| TF1: |
| TF1: |
| TF2:--. |

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Column 8, in the table entitled *Rolling Schedule For Two Stand Tandem Reversing Hot Strip Mill*, under the ninth column, in the top half of the table, entitled 'Mill Speed FPM, Roll', Pass No. 1, "318.9*" should read --518.9*--.

Column 8, in the table entitled *Rolling Schedule For Two Stand Tandem Reversing Hot Strip Mill*, under the fifth column, in the top half of the table, entitled 'Bite Angle Deg.', Pass No. 4, "11.20" should read --11.28--.

Column 8, in the table entitled *Rolling Schedule For Two Stand Tandem Reversing Hot Strip Mill*, under the seventh column, in the top half of the table, entitled 'Length ft.', Pass No. 9, "2303.8" should read --2503.8--.

Column 8, in the table entitled *Rolling Schedule For Two Stand Tandem Reversing Hot Strip Mill*, under the sixth column, in the bottom half of the table, entitled 'Roll Force, lb x 10**6', Pass No. 1, "2.6914" should read --2.6934--.

Column 9, in the table entitled *Rolling Schedule For Two Stand Tandem Reversing Hot Strip Mill*, under the sixth column, in the bottom half of the table, entitled 'Roll Force, lb x 10**6', Pass No. 3, "3.6551" should read --3.8351--.

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Column 9, in the table entitled *Rolling Schedule For Two Stand Tandem Reversing Hot Strip Mill*, under the eighth column, in the bottom half of the table, entitled 'Horse Power', Pass No. 3, "27633." should read --27833.--.

Column 9, in the table entitled *Rolling Schedule For Two Stand Tandem Reversing Hot Strip Mill*, under the ninth column, in the bottom half of the table, entitled 'Load Ratio', Pass No. 3, "1.6017" should read --1.8017--.

Column 9, in the table entitled *Rolling Schedule For Two Stand Tandem Reversing Hot Strip Mill*, under the eighth column, in the bottom half of the table, entitled 'Horse Power', Pass No. 4, "28391." should read --28591.--.

Column 9, in the table entitled *Rolling Schedule For Two Stand Tandem Reversing Hot Strip Mill*, under the fifth column, in the bottom half of the table, entitled 'Exit Temperature Deg. F.', Pass No. 5, "2048.0" should read --2040.0--.

Column 9, in the table entitled *Rolling Schedule For Two Stand Tandem Reversing Hot Strip Mill*, under the sixth column, in the bottom half of the table, entitled 'Roll Force, lb x 10**$^{6}$', Pass No. 5, "3.9282" should read --3.9262--.

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Column 9, in the table entitled *Rolling Schedule For Two Stand Tandem Reversing Hot Strip Mill*, under the sixth column, in the bottom half of the table, entitled 'Roll Force, lb x 10**6', Pass No. 6, "5.1308" should read --3.1308--.

Column 9, in the table entitled *Rolling Schedule For Two Stand Tandem Reversing Hot Strip Mill*, under the sixth column, in the bottom half of the table, entitled 'Roll Force, lb x 10**6', Pass No. 7, "2.9536" should read --2.9526--.

Column 9, in the table entitled *Rolling Schedule For Two Stand Tandem Reversing Hot Strip Mill*, under the fourth column, in the bottom half of the table, entitled 'Entry Temperature Deg. F.', Pass No. 8, "1836.8" should read --1856.8--.

Column 9, in the table entitled *Rolling Schedule For Two Stand Tandem Reversing Hot Strip Mill*, under the sixth column, in the bottom half of the table, entitled 'Roll Force, lb x 10**6', Pass No. 8, "1.8790" should read --2.8790--.

Column 9, in the table entitled *Rolling Schedule For Two Stand Tandem Reversing Hot Strip Mill*, under the ninth column, in the bottom half of the table, entitled 'Load Ratio', Pass No. 8, ".5814" should read --.5844--.

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Column 9, in the table entitled *Rolling Schedule For Two Stand Tandem Reversing Hot Strip Mill*, under the tenth column, in the bottom half of the table, entitled 'RMS Time sec.', Pass No. 9, "7.49" should read --7.45--.

Column 9, the first line of text following the table, "Tandom" should read --Tandem--.

Column 9, the first line of text following the table, "467.52 1PH" should read --467.52 TPH--.

Column 9, the second line of text following the table, "Tandom" should read --Tandem--.

Column 9, the second line of text following the table, "467.52 1PH" should read --467.52 TPH--.

Column 9, the third line of text following the table, "Pase" should read --Pass--.

Column 9, the third line of text following the table, "4* 1F1*" should read --4* TF1*--.

Column 9, the sixth line of text following the table, "Furnance" should read --Furnace--.

Column 9, the seventh line of text following the table, "Furnance" should read --Furnace--.

UNITED STATES PATENT AND TRADEMARK OFFICE

CERTIFICATE OF CORRECTION

PATENT NO. : 5,467,519

DATED : November 21, 1995

INVENTOR(S) : George W. Tippins and John E. Thomas

It is certified that error appears in the above-indentified patent and that said Letters Patent is hereby corrected as shown below:

Column 9, the ninth line of text following the table, "Final Temperature at:" should read --Final Temperature at TS:--.

Column 9, the twelfth line of text following the table, "*After Front Time" should read --#After Front Time--.

Column 9, the twelfth line of text following the table, "Tandom" should read --Tandem--.

Signed and Sealed this

Twenty-eighth Day of May, 1996

*Attest:*

Bruce Lehman

BRUCE LEHMAN

*Attesting Officer*

*Commissioner of Patents and Trademarks*